US007991174B2

(12) United States Patent
Huynh et al.

(10) Patent No.: US 7,991,174 B2
(45) **Date of Patent: *Aug. 2, 2011**

(54) HEARING AID BATTERY BARRIER

(75) Inventors: Timothy C. Huynh, San Jose, CA (US); Sharon Huynh, legal representative, San Diego, CA (US); Sunder Ram, San Jose, CA (US); Richard Gable, Sunnyvale, CA (US)

(73) Assignee: InSound Medical, Inc., Newark, CA (US)

( * ) Notice: Subject to any disclaimer, the term of this patent is extended or adjusted under 35 U.S.C. 154(b) by 1329 days.

This patent is subject to a terminal disclaimer.

(21) Appl. No.: 11/426,866

(22) Filed: Jun. 27, 2006

(65) Prior Publication Data

US 2007/0003084 A1 Jan. 4, 2007

Related U.S. Application Data

(60) Provisional application No. 60/696,276, filed on Jun. 30, 2005.

(51) Int. Cl.
*H04R 25/00* (2006.01)

(52) U.S. Cl. ..... 381/328; 381/322; 381/324

(58) Field of Classification Search ..... 381/322–323, 381/328; 429/27, 29, 86, 100; 137/625.33
See application file for complete search history.

(56) References Cited

U.S. PATENT DOCUMENTS

| | | | | |
|---|---|---|---|---|
| 5,328,778 | A * | 7/1994 | Woodruff et al. | 429/27 |
| 5,401,920 | A | 3/1995 | Oliveira | |
| 5,458,988 | A * | 10/1995 | Putt | 429/27 |
| 5,486,429 | A * | 1/1996 | Thibault | 429/27 |
| 5,724,431 | A * | 3/1998 | Reiter et al. | 381/322 |
| 6,574,343 | B1 | 6/2003 | Meier | |
| 7,379,555 | B2 * | 5/2008 | Gable et al. | 381/322 |
| 2004/0140114 | A1 | 7/2004 | Wagner | |

OTHER PUBLICATIONS

Ballachanda, "Cerumen and the Ear Canal Secretory System", *The Human Ear Canal*, Singular Publishing, 1995, p. 195.

* cited by examiner

*Primary Examiner* — Suhan Ni
(74) *Attorney, Agent, or Firm* — Henricks, Slavin & Holmes LLP

(57) ABSTRACT

Embodiments of the invention provide a barrier for protecting hearing aid metal-air battery assemblies from exposure to liquids causing obstruction of a battery air vent. One embodiment provides a barrier configured to be attached to a CIC hearing aid battery having a vent. The barrier has an oxygen permeability configured to allow the diffusion of sufficient oxygen for a battery to meet the power demands of a hearing aid operating in the bony portion of the ear canal over an extended time period. The barrier has a physical property configured to substantially prevent liquid obstruction of at least a portion of the vent on a metal-air battery such as a zinc-air battery. The physical property can be at least one of a hydrophobicity, oleophobocity or surface energy. The barrier can be directly attached to the battery or indirectly via a holder and can encase substantially the entire battery.

14 Claims, 4 Drawing Sheets

HEARING AID BATTERY BARRIER

CROSS-REFERENCES TO RELATED APPLICATIONS

This application claims the benefit of priority of U.S. Provisional Application Ser. No. 60/696,276, entitled, *Hearing Aid Battery Barrier*, filed on Jun. 30, 2005, the full disclosure of which is incorporated herein by reference.

This application is also related to U.S. Provisional Application Ser. No. 60/696,265, entitled, *Hearing Aid Microphone Protective Barrier*, filed on Jun. 30, 2005; and U.S. patent application Ser. No. 11/058,097 entitled, *Perforated Cap Assembly for a Hearing Aid*, filed on Feb. 14, 2005, the full disclosure of each being incorporated herein by reference.

BACKGROUND OF THE INVENTION

Field of the Invention

Embodiments of the invention relate to hearing aid batteries. More specifically, embodiments of the invention relate to barriers applied to hearing aid batteries for protecting the battery from exposure to water or debris.

Since many hearing aid devices are adapted to be fit into the ear canal, a brief description of the anatomy of the ear canal will now be presented. While, the shape and structure, or morphology, of the ear canal can vary from person to person, certain characteristics are common to all individuals. Referring now to FIGS.1-2, the external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (aw) motions, which occur during talking, yawning, eating, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-artilaginous junction 19 (referred to herein as the bony junction), which separates the cartilaginous 11 and the bony 13 regions. The magnitude of this bend varies among individuals.

A cross-sectional view of the typical ear canal 10 (FIG. 2) reveals generally an oval shape and pointed inferiorly (lower side). The long diameter ($D_L$) is along the vertical axis and the short diameter ($D_S$) is along the horizontal axis. These dimensions vary among individuals.

Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see e.g., Ballachanda, The Human ear Canal, Singular Publishing, 1995, pp. 195). There is no cerumen production or hair in the bony part of the ear canal.

The ear canal 10 terminates medially with the tympanic membrane 18. Laterally and external to the ear canal is the concha cavity 2 and the auricle 3, both also cartilaginous. The junction between the concha cavity 2 and the cartilaginous part 11 of the ear canal at the aperture 17 is also defined by a characteristic bend 12 known as the first bend of the ear canal.

First generation hearing devices were primarily of the Behind-The-Ear (BTE) type. However, they have been largely replaced by In-The-Canal hearing devices are of which there are three types. In-The-Ear (ITE) devices rest primarily in the concha of the ear and have the disadvantages of being fairly conspicuous to a bystander and relatively bulky to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. These devices fit deep within the ear canal and can be essentially hidden from view from the outside.

In addition to the obvious cosmetic advantages, CIC hearing devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

Many commercially available hearing aids including CIC hearing aids employ storage batteries including metal-air batteries as a power source. The electrochemistry of these batteries require oxygen in order to generate current and thus the battery enclosure must have a vent hole. However, the performance of many hearing aid metal-air batteries is adversely effected by exposure to water and other liquids that wet the surface of the battery, clog the vent holes and deprive the battery of oxygen. To circumvent this problem, many hearing aid designs employ auxiliary battery enclosures to limit fluid exposure and provide a residual backup volume of air. However, this adds additional size to the overall design of the hearing aid and still does not guarantee reliability upon exposure to liquid water from activities such as showering or swimming. There is a need for an improved metal air-battery design for hearing aid devices including CIC devices.

BRIEF SUMMARY OF THE INVENTION

Embodiments of the invention provide a barrier for protecting hearing aid batteries from exposure to aqueous and other liquids. Many embodiments provide a barrier configured to prevent obstruction of the vent holes on hearing aid metal-air batteries from liquids or debris. One embodiment provides a barrier configured to be attached to a completely in the canal (CIC) hearing aid battery having a vent. The barrier has an oxygen permeability configured to allow the diffusion of sufficient oxygen for a battery to meet the power demands of a hearing aid operating in the bony portion of the ear canal over an extended time period. The barrier also has a physical property configured to substantially prevent liquid obstruction of at least a portion of the vent on a metal-air battery such as a zinc-air battery. The physical property can be at least one of a hydrophobicity, a oleophobicity, a surface property or a surface energy. The barrier can also be configured to substantially prevent liquid and/or particulate ingress into the vent as well as prevent a substantial reduction in oxygen or other gas diffusion to the battery. The barrier can include one or more of a porous material, a film, a porous film, a micro-porous film, a coated micro-porous film, a treated micro-porous film, a permselective film, or a non-porous film. The barrier can be configured to provide sufficient protection of the battery to allow the battery to survive exposure to various fluids such as water, pool water, soap solutions, etc. without appreciable degradation in battery performance (e.g., current, capacity, etc). The barrier can include multiple layers and in one embodiment, can include a first layer having a first property and second layer including a second property. The layers can be adhered or otherwise sandwiched together.

Another embodiment provides a battery assembly for a CIC hearing aid, the assembly comprises a metal-air battery having a vent and a barrier attached to the battery. The barrier has an oxygen permeability configured to allow the diffusion of sufficient oxygen for the battery to meet the power demands of a hearing aid operating in the bony portion of the ear canal over an extended time period. This period can be hours, days or months, for example, six months. For embodiments having a microporous barrier material, the barrier can meet such demands with as little as 2% patentcy. The barrier has a physical property configured to substantially prevent liquid obstruction of at least a portion of a vent on a metal-air battery such as a zinc-air battery.

Many embodiments provide CIC hearing aids for operation in the bony portion of the ear canal with a battery assembly an including an embodiment of the battery barrier. Such configurations provide a CIC hearing aid with a battery assembly that resists failures modes due to the presence of moisture and condensation in the ear canal. The hearing aid comprises a microphone assembly, receiver assembly and battery assembly including an embodiment of the battery barrier. The microphone is configured to receive incoming acoustic signals for processing by the hearing aid. The receiver assembly is configured to supply acoustical signals received from the microphone assembly to a tympanic membrane of a wearer. The battery assembly is configured to power the device and is electrically coupled to at least one of the microphone assembly or the receive assembly. At least one sealing retainer can be coupled to at least one of the microphone assembly or the receiver assembly.

In many embodiments, the barrier can be positioned to provide a selectable reservoir volume of air between the battery and barrier. This can be achieved by the use of a spacer such as a grommet or other barrier holder to which the barrier is attached. The reservoir volume can be configured to provide a selectable time period of operation of the battery in situations where the diffusion of ambient air (i.e., that outside the ear canal) to the battery is reduced or ceases entirely, for example when the user goes swimming, bathes or otherwise retains water in the ear canal. In one embodiment, the reservoir can be configured to supply enough oxygen for at least one hour of battery operation. In other embodiments, the reservoir can be configured to provide longer periods of operation, e.g., two, three, four etc.

In an exemplary embodiment of a method for using the barrier in a hearing device, a CIC hearing aid having a metal air battery assembly including a vent and an embodiment of the barrier is positioned in a portion of the in the ear canal such as the bony portion. Air diffuses through the barrier and vent to allow the battery to generate sufficient voltage to power the hearing aid. Typically, the minimum sufficient voltage will be in the range from about 1 to 1.4 volts and more preferably about 1.2 to 1.35 volts. The barrier serves to maintain a degree or amount of patentcy of the vent (by preventing liquid obstruction) so as to maintain sufficient diffusion of oxygen to the battery even after extended periods of wear in the ear canal (e.g., up to six months or longer). This in turn, allows the battery to maintain sufficient voltage to power the hearing aid after the extended period of wear. Further, the barrier provides sufficient diffusion of oxygen to allow the hearing aid to be stay in a powered state continuously for periods of hours, days or months. Typically, the device will be used in on state for about 16 hours a day and in a standby state for about 8 hours (e.g. during sleep), though other cycles may also be employed depending upon the user. By providing both protective function and a diffusion function, the barrier allows a CIC hearing aid to be used continuously in such a fashion for periods for up to six months or longer. Further aspects and embodiments of the invention are described in the detailed description below.

DETAILED DESCRIPTION OF THE INVENTION

Various embodiments of the invention provide one or more protective barriers for batteries used in conjunction with completely-in-the-canal (CIC) hearing aids. The barriers are particularly useful for protecting metal-air batteries, such as zinc-air batteries which require an influx of oxygen to generate electricity. The battery barrier provides a means of protection against liquids from compromising the performance of metal-air batteries by wetting or otherwise clogging vent holes on the battery structure. In preferred embodiments, the barrier has physical properties configured to allow sufficient oxygen diffusion into a battery vent hole to meet the power demands of the hearing aid while preventing the vent from being wetted or otherwise obstructed with aqueous liquids. In one or more embodiments, the barrier can be configured to allow the battery to functionally survive intermittent exposure to various fluids such as water, soap solutions, etc.

The protective barrier can be configured to repel fluids that the battery is expected to contact (e.g., water, sweat, soap, body oils, cerumen, and combinations thereof). Preferably, the barrier is sufficiently repelling of water and other fluids, such that no or minimal fluid is left on the barrier surface when portions of hearing aid or battery assembly exposed to fluids. Also, the barrier has an oxygen permeability configured to allow sufficient oxygen diffusion/ingress into the battery to generate sufficient current to meet the power demands of the hearing aid when hearing aid is operating for extended periods in the ear canal. The period of operation can be hours days or even months. Further, the barrier has sufficient oxygen permeability to allow the hearing to operate when the hearing aid is positioned at any location in the ear canal including the deeper portions the canal such as the bony portion. Also, in various embodiments, the barrier can be positioned to provide a selectable volume of air between the battery and barrier. This volume of air acts as a reservoir that can be used by the battery during temporary coverage of the battery with fluid or other obstruction that prevents air from reaching the battery.

Figure 1:
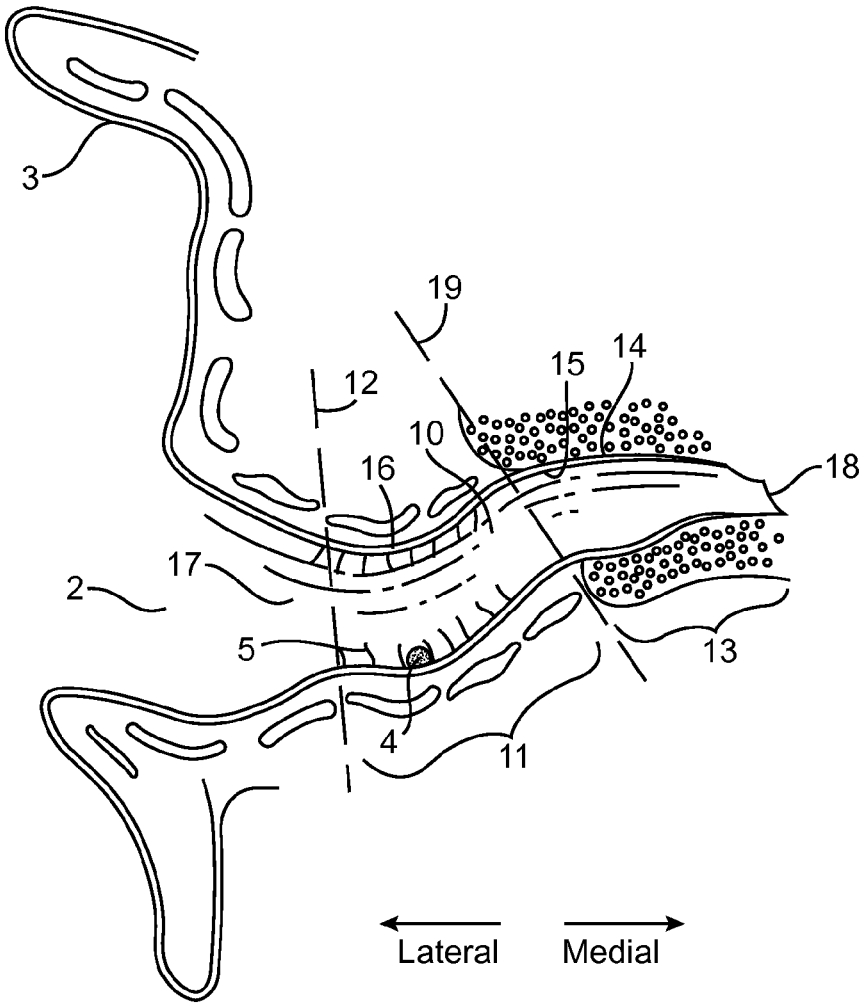
FIG. 1 is a side coronal view of the external ear canal.
Figure 2:
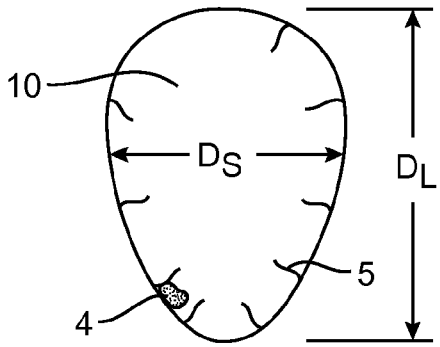
FIG. 2 is a cross-sectional view of the ear canal in the cartilaginous region.
Figure 3:
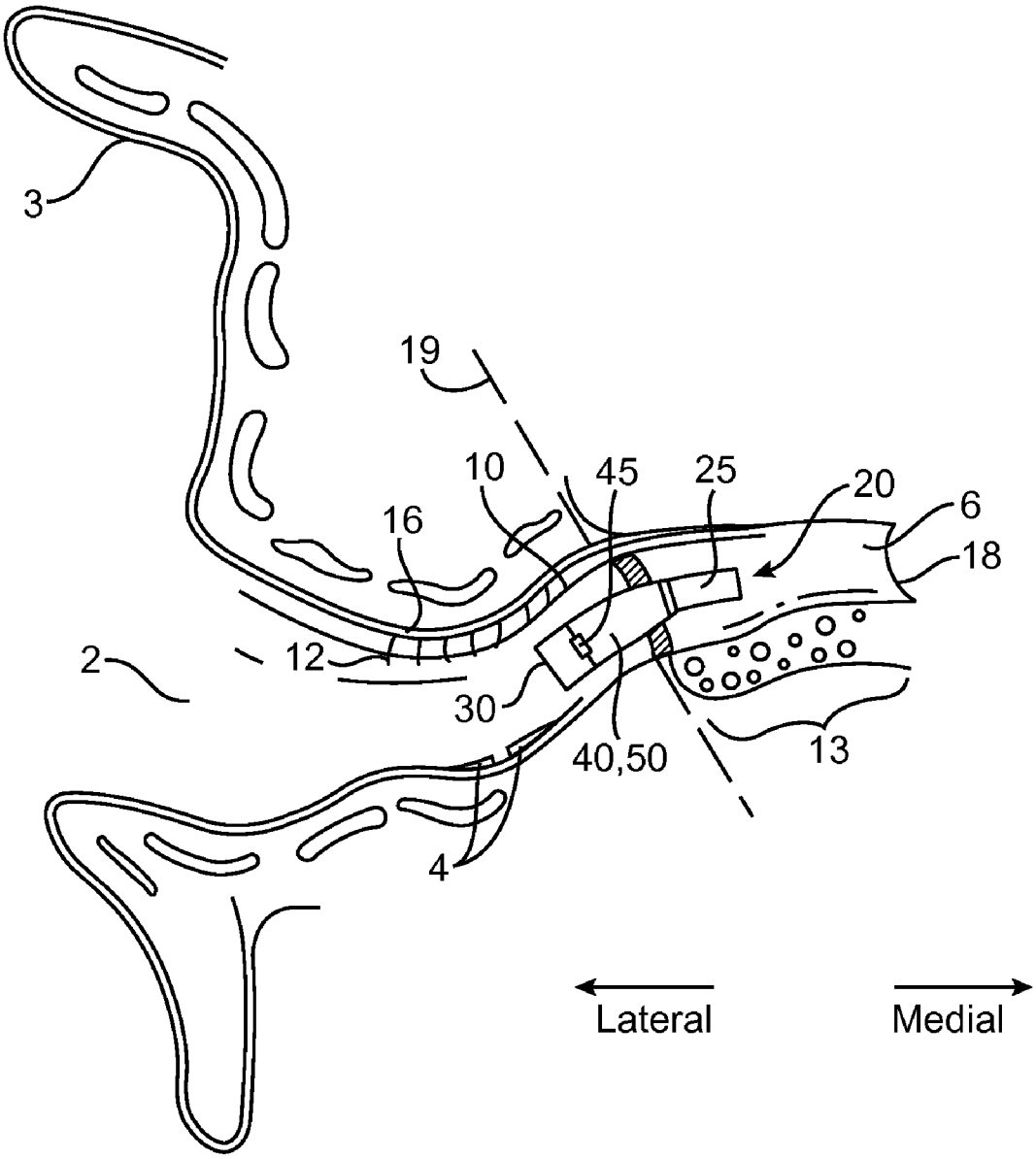
FIG. 3 is a lateral view illustrating an embodiment of a hearing aid device positioned in the bony portion of the ear canal.

Referring now to FIG. 3, embodiments of a hearing device 20 utilizing an embodiment of the barrier will now be described. In exemplary embodiments, hearing device 20 is a CIC hearing aid, but it should be appreciated that other types of hearing aids are equally applicable. CIC hearing aid 20 includes a microphone module 30 and receiver or speaker module 25 and a battery module 40 including a battery 50. In various embodiments, battery 50 can employ a variety of electrochemistrys known in the art including, but not limited to lithium, lithium-polymer, lithium-ion, nickel cadmium, nickel-metal hydride, or lead-acid or combinations thereof In preferred embodiments, battery 50 is a zinc-air or other metal-air battery known in the art. Accordingly, in embodiments including a metal-air battery, battery module 40 will include a vent 45 for the influx of oxygen to power the battery via an electrochemical reaction utilizing oxygen. Examples of other metal-air batteries include aluminum, magnesium and lithium-air batteries.

Figure 4A:
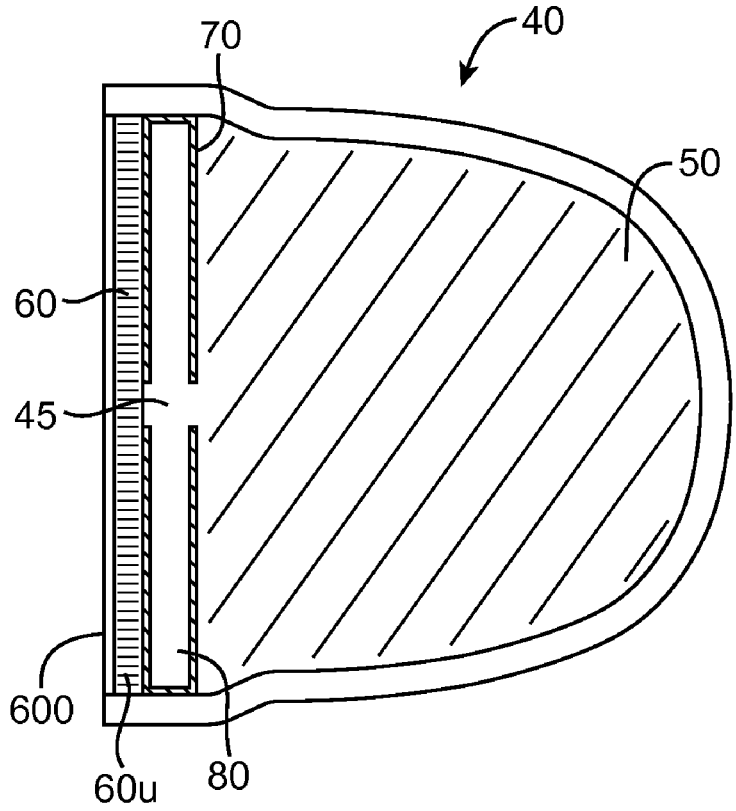
FIGS. 4A-4B are cross sectional and frontal views illustrating an embodiment of a hearing aid battery having a barrier attached to the battery using a battery holder.
Figure 4B:
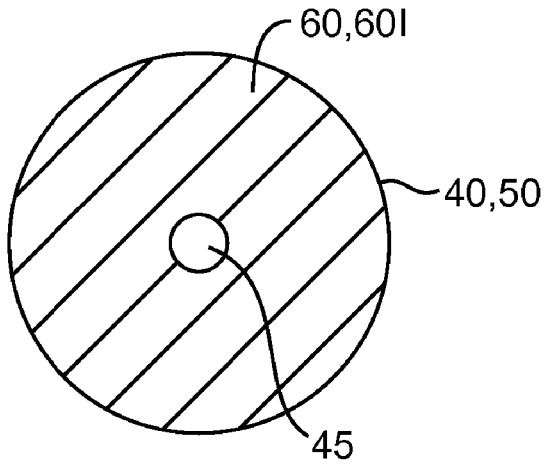
Figure 5:
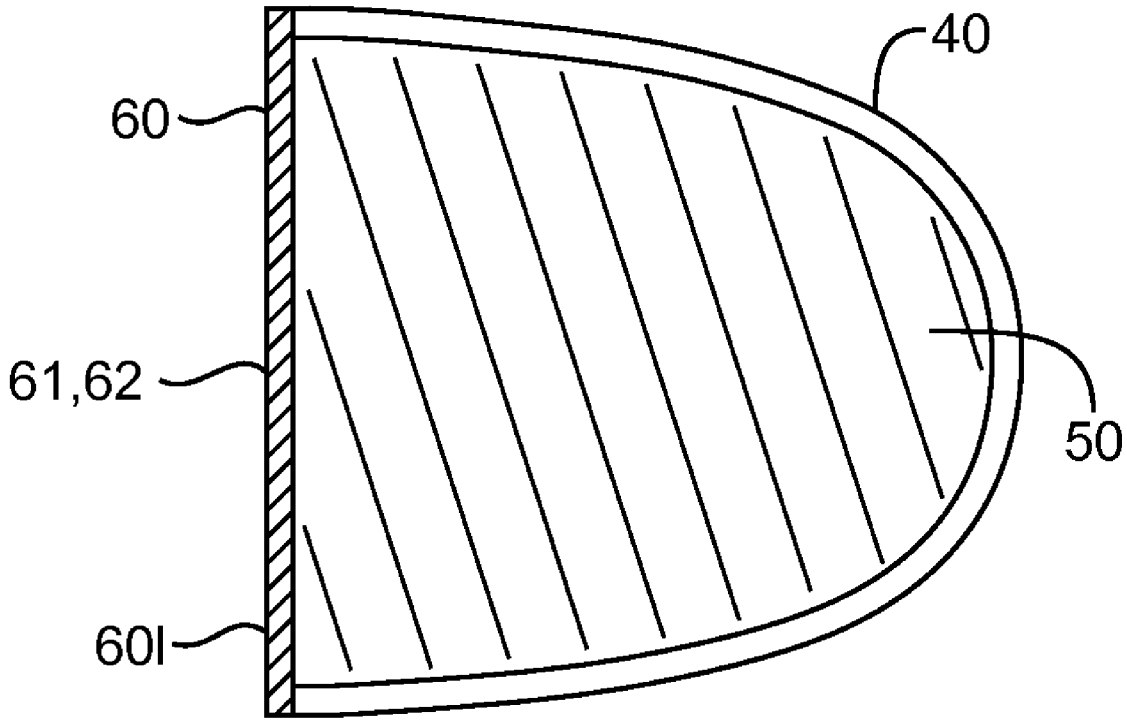
FIG. 5 is a lateral view illustrating an embodiment of a hearing aid battery having a barrier.

Referring now to FIGS. 4-5, in various embodiments battery module 40 includes a barrier 60 that is desirably configured to be both liquid repelling and oxygen permeable. Barrier 60 can comprise a single layer 601 or multiple layers of material adhered or otherwise sandwiched together. The layers can have different properties, for example an outer layer 60*o* can be a hydrophobic layer and underlying layer 60*u* can be a oleophobic layer. The barrier can be attached directly to the battery 50 including directly to vent 45, or indirectly, for example, by a holder. Barrier 60 can be attached to a selectable portion of the battery or the entire battery and can thus encase the entire battery. Also, barrier 60 can be configured to have one or more of the following properties or qualities: i) oxygen/air permeable; ii) hydrophobic; iii) water impermeable; iv); acoustically dampening;; and v) oleophobic (i.e. cerumen/oil/lipid repelling, this terms is also synonymous with lipophobic).

In preferred embodiments, barrier 60 is configured to prevent wetting and fluid obstruction of the vent by various liquids encountered in the ear canal. Such solutions can include various aqueous solutions and lower surface tension solutions such as cerumen and other lipid containing solutions. The barrier is also configured to allow sufficient oxygen diffusion through the vent for the battery to maintain sufficient minimum voltage to meet the current/powers demands of the hearing aid. That is, there is sufficient oxygen influx to meet the stochiometric requirements of the particular electrochemical reaction with which the battery generates electricity. Such stochiometric requirements are known and/or readily determined by those skilled in the art using the half-cell reaction formula for the particular battery. The minimum voltage is typically in the range from 1 to 1.4 volts for battery current drains in the range from about 30 to 65 μA. In preferred embodiments, the minimum voltage is 1.2 to 1.35 volts for current drain typically in the ranges of about 30 to 45 μA with an upper range of about 55-65 μA.

The fluid repelling, air diffusion function of the barrier can be achieved by configuring the barrier to have a combination of physical properties. In preferred embodiments, the combination of physical properties of the barrier includes hydrophobicity and oxygen permeability, the former causing repulsion of aqueous liquids from the surface of the barrier and the latter allowing diffusion of oxygen through the barrier. Desirably, the barrier is also oleophobic as well. The desired amount of hydrophobicity can be achieved through the use of one or more hydrophobic materials known in the art such as silicones and fluoro-polymers (e.g., expanded PTFE) and/or the coating or treatment of the barrier with hydrophobic agents. One or both of hydrophobicity and oleophobicity can be quantified using surface tension (also known as surface energy). In various embodiments, the surface tension of the barrier can range from about 17 dynes/cm to about 50 dynes/cm. Hydrophobicity can be specifically quantified by measuring the contact angle of a water droplet on the surface using for example, the sessile drop method or other measurement techniques known in the art. Similarly, the amount of oleophobicity can be quantified via measurement of the contact angle of various lipid/oil solutions on the surface using, for example, such as test methods described in AATCC test 118-1992. Also for the case of porous barriers, the degree of hydrophobicity can be quantified by the amount of pressure required to force water through the barrier. The barrier can configured to resist selected amounts of hydrostatic pressure tending to force water or other aqueous solution into the barrier. In various embodiments the barrier can be configured to resist entry to liquid water for pressure up to about 1 atm, up to about 3 atms or even up to about 5 atms.

Oxygen permeability of the barrier can be measured using one ore more methods known in the art such as those described in ASTM D3985. The desired amount of oxygen permeability can be achieved by the use of oxygen permeable material known in the art such as silicones, PTFE's and other micro-porous materials. In a preferred embodiment, the barrier is a porous fluoro-polymer or a micro-porous polymer coated with a super hydrophobic coating. Alternative embodiments of the barrier can include a super hydrophobic non-porous polymer with high oxygen permeability.

In various embodiments, the barrier can be configured to protect both the vent and the entire battery from exposure to fluids as well as particulates which may cause obstruction of all or at least a portion of the vent. In one embodiment, the barrier is configured to prevent fluid obstruction of the vent by water or other liquids contacting the vent or otherwise blocking the surface portion of barrier material over the vent. This can be achieved by configuring the barrier to have sufficient hydrophobicity to cause liquid water or other aqueous solutions to bead off the surface of the barrier. Similarly, the barrier can be sufficiently oleophobic to repel cerumen and other lipid/fatty acid matter whether liquid or particulate. Further, the fluid and particulate protecting qualities of the barrier can be configured to maintain the patentcy of the vent to substantially prevent degradation in one or more battery performance parameters including current, power and capacity due to decrease in oxygen diffusion through the vent. The barrier can also be configured to substantially encapsulate and protect the entire battery from exposure to water and other liquids and particulate matter which may compromise battery performance including current, power or capacity. In still other embodiments, the barrier can include multiple portions, for example, one portion protecting the vent and another portion protecting the remainder of the barrier. The vent portion can be oxygen permeable and the remainder portion need not be. For example, the vent portion could comprise a micro-porous PTFE material and the remainder of the barrier can be made of parylene or other air/gas impermeable material. The parylene can be applied using vacuum coating methods known in the art. Encasing the entire battery, except the vent portion, with an air/gas impermeable material provides another means for preventing/reducing water entry and obstruction of the battery vent by preventing the displacement of air inside the battery by entering water, thus requiring increased hydrostatic pressure for water entry.

In various embodiments, the barrier can be attached indirectly to the battery. In an embodiment shown in FIGS. 4A-4B, the barrier 60 can be attached to the battery by a barrier holder 70 attached to the battery 60. Holder 70 can comprise a thin grommet, ring, tape or gasket material, manifold or the like and can have similar properties as the barrier, e.g., hydrophobicity, oxygen permeability, etc or different properties. Holder 70 can also comprise an adhesive or liquid polymer (e.g., silicone) that is applied and then cured in place on the battery. Barrier 60 can be attached to holder 70 using adhesives known in the art including medical adhesives. Suitable medical grade adhesives include but are not limited to medical grade silicone and cyano-crylate adhesives known in the art. In one embodiment the adhesive is applied in a substantially circular ring to the barrier. Also one or both of holder 70 or barrier 60 can be configured to form a seal (e.g., mechanical, moisture, etc) with other portions of the hearing aid 20 such as the microphone module 30. In such embodiments, it is desirable to have holder 70 fabricated from a gasket or other sealing material known in the art. Suitable materials include silicone rubber.

In many embodiments, a protective barrier can be placed directly on the battery. In the embodiment shown in FIG. 5 the barrier 60 comprises an oxygen permeable polymer film or layer 61 attached to all or a portion of the battery surface. Suitable oxygen permeable films include porous fluoro polymer films such as expanded PTFE films. Example PTFE films include those available from W. L. Gore & Associates (Flagstaff, Ariz.). In other embodiments, barrier 60 can comprise a coated or treated micro-porous film 62. Suitable coatings and treatments include hydrophobic surface agents or surface treatments configured to reduce surface tension (e.g., plasma treatment, chemical treatment, chemical vapor deposition, etc). In still other embodiments, barrier 60 can comprise an oxygen permeable and/or permselective film or membrane known in the art, examples of which include silicone and fluoro-polymers. The permselective film can be configured to allow the diffusion/permeation of oxygen through the film while substantially limiting or preventing that for water vapor. In one embodiment, barrier 60 can comprise a non porous oxygen permeable and/or permselective thin film. The oxygen permeability and/or permselectivity of the film can be configured to allow the diffusion of sufficient oxygen for the battery to generate sufficient current to meet the minimum power requirements of the battery under varying ambient conditions. For embodiments having a microporous barrier material, the barrier can meet such demands with as little as 2% patentcy (i.e., 98% of the pores are clogged). Also, the barrier can be configured to be acoustically dampening so as to absorb or otherwise prevent the reflection of sound waves hitting the barrier. This latter function can be achieved through the use of acoustically dampening materials known in the art. The acoustically dampening qualities of the barrier function to reduce the levels of unwanted feedback from sound bouncing off of the barrier or other surface in the hearing aid.

In various embodiments, the diffusion/permeability properties of the barrier can be selected for particular environmental conditions or combinations therefore e.g., high temperature, high humidity, low temperature, low humidity or even a combination thereof. Also, in various embodiments the barrier can be configured to substantially prevent the influx of water or other aqueous solutions for various hydrostatic pressures to which the battery and/or hearing aid are exposed. For example, the barrier can be configured to prevent water penetration for fluid pressures resulting from swimming several feet under water (e.g., approximately 1 to 2 atms). Also the surface of the membrane can be configured to have sufficient hydrophobicity to prevent the ingress of solutions including surfactants solutions (e.g., soap solutions ) and/or if the surface of the membrane is otherwise exposed to surfactants. Determination of resistance of the barrier to ingress of various fluids can be made using bubble point test methods known in the art.

The thickness of the barrier can be selected in view of several parameters including, without limitation, form factor, oxygen diffusion rates, hydrophobocity and acoustical dampening. In various embodiments, the thickness of barrier 60 can range from about $1\times10^{-5}$ to 5 mm, with specific embodiments of $1\times10^{-5}$, 0.006, 0.01 and 3 mm. The thickness of the barrier can be selected in view of one or more of the following parameters: oxygen diffusion requirements, dimensional requirements, acoustical requirements, moisture barrier requirements, and cerumen barrier requirements and the like. Also, in embodiments where the barrier is constructed from porous materials, the pore size can be in the range of about 0.1 to 1 micron with a preferred range of about 0.2 to 0.5 microns. The material can also have pore density ranging from about 1 to $5\times10^{8}$pores/cm$^2$ with a preferred embodiment of $3\times10^{8}$pores/cm$^2$. Particular combinations of pore density and pore size can be selected to achieve a desired amount of diffusion. In a preferred embodiment, the membrane can be configured to have a 0.2 micron pore size with a pore density of $3\times10^{8}$pores/cm$^2$. Suitable porous materials can include without limitation, polyether sulfone, NYLON, polyester, cellulose acetate, polyvinyl fluoride, nitrocellulose, polyvinylidene and like materials.

In various embodiments, barrier 60 can be positioned with respect to the battery to provide a selectable reservoir volume of air 80 between the battery and the barrier. This reservoir volume can be controlled by modification of the structures holding the barrier to the battery. In particular embodiments, the reservoir volume can be configured to provide a selectable time period of operation of the battery/hearing aid at a minimum current when the battery vent is partially or fully obstructed and/or the rate of oxygen ingress into the battery vent falls below a threshold level. In one embodiment, the reservoir is configured to provide sufficient oxygen for approximately one hour of hearing aid operation. In use, such embodiments allow the user to continue to retain functionality of their hearing aid when they engage in activities such as swimming, bathing, or sports where the ear canal becomes temporally obstructed with pool water, bath water/shampoo or even sweat. The hearing aid can contain sensing algorithms which detect such obstruction (e.g., by the detection of decreased battery voltage, current, or both below a threshold level, and/or rate of decrease) and then switch to a lower power operating mode so as to prolong operation during such periods of obstruction. The hearing aid can even send a signal to the user, e.g., in the form of an audible beep, indicating detection of decreased oxygen and the switching to the lower power mode. Such algorithms can be in the form of electronic instructions or a module resident with an electronic processor contained within the receiver or the assembly. In one embodiment, the instructions can be a subroutine of a power management module resident or electronically coupled to the processor.

EXAMPLES

Various embodiments of the invention will now be further illustrated with reference to the following examples. However, it will be appreciated that these examples are presented for purposes of illustration and the invention is not to be limited by these specific examples or the details therein.

Example I

In this example a self-supporting porous 3-mil thick fluoropolymer film was attached to hearing aid battery surface using a ring of adhesive. The battery was circular at 8 mm in diameter; the adhesive ring was composed of a pressure sensitive adhesive with adequate adhesive strength to the fluoropolymer. It had a flat profile with OD=6.5 mm and ID=4.5 mm. The thickness of the adhesive was 1 mil.

Example II

In this example a thin micro-porous polycarbonate film was used. This micro-porous film was treated by physical/chemical methods to increase the hydrophobic character of the surface. The film was 10 microns thick and elliptical in shape conforming to the shape of the hearing aid battery. The long axis was approximately 5 mm and the short axis was approximately 3 mm. The barrier was adhesively attached to a nylon support which was then adhesively attached to the elliptical battery.

Example III

In this example a thin film coating was directly applied to the hearing aid battery. A solvent born amorphous fluoropolymer with high oxygen permeability and excellent film forming capability was used. This coating covered the surface of the battery and bridged over the battery air vent holes. The coating was approximately 300 Angstroms thick, very hydrophobic and allowed enough oxygen permeability for the needed battery operational current demand.

Conclusion

The foregoing description of various embodiments of the invention has been presented for purposes of illustration and description. It is not intended to limit the invention to the precise forms disclosed. Many modifications, variations and refinements will be apparent to practitioners skilled in the art. Further, the teachings of the invention have broad application in the hearing aid device fields as well as other fields which will be recognized by practitioners skilled in the art.

Elements, characteristics, or acts from one embodiment can be readily recombined or substituted with one or more elements, characteristics or acts from other embodiments to form numerous additional embodiments within the scope of the invention. Hence, the scope of the present invention is not limited to the specifics of the exemplary embodiment, but is instead limited solely by the appended claims.

What is claimed is:

1. A battery assembly for a CIC hearing aid, the assembly comprising:

a metal-air battery having a vent; and a barrier attached to the battery, the barrier having an oxygen permeability configured to allow the diffusion of sufficient oxygen for the battery to meet a power demand of the hearing aid operating in an ear canal over an extended time period, the barrier having a physical property configured to substantially prevent liquid obstruction of at least a portion of the vent, wherein the barrier encases substantially the entire battery.

2. A battery assembly for a CIC hearing aid, the assembly comprising:

a metal-air battery having a vent;

a barrier attached to the battery, the barrier having an oxygen permeability configured to allow the diffusion of sufficient oxygen for the battery to meet a power demand of the hearing aid operating in an ear canal over an extended time period, the barrier having a physical property configured to substantially prevent liquid obstruction of at least a portion of the vent; and a barrier holder attached to the battery, wherein the barrier is attached to the battery via the barrier holder, and wherein the barrier is positioned on the holder to produce a reservoir volume of air between the battery and the barrier, the volume of air allowing operation of the hearing aid for a select period when oxygen ingress into the battery vent decreases below a threshold level.

3. The battery assembly of claim 1 or 2, wherein the barrier allows the diffusion of sufficient oxygen for the battery to generate a minimum voltage in the range of about 1 to 1.4 volts.

4. The battery assembly of claim 1 or 2, wherein the barrier is one of a film, a porous material, a porous film, a micro-porous film, a coated micro-porous film, a treated micro porous film or a permselective film.

5. The battery assembly of claim 1 or 2, wherein the barrier is a porous material which allows diffusion of the sufficient oxygen with a potency of about 2% or greater.

6. The battery assembly of claim 1 or 2, wherein the barrier is a porous material which has a pore size in the range of about 0.2 to 0.5 microns.

7. The battery assembly of claim 1 or 2, wherein the barrier is a porous material which has a pores density in the range of about 1 to 5 x 108 pores/cm2.

8. The battery assembly of claim 1 or 2, wherein the physical property is at least one of hydrophobicity, oleophobicity or surface energy.

9. The battery assembly of claim 1 or 2, wherein the barrier is directly attached to the vent.

10. The battery assembly of claim 1 or 2, wherein the barrier includes a first portion positioned proximate the vent and a remainder portion, the remainder portion having a lower oxygen permeability than the first portion.

11. The battery assembly of claim 1, further comprising:

a barrier holder attached to the battery, wherein the barrier is attached to the battery via the barrier holder.

12. The battery assembly of claim 1 or 2, wherein the extended time period is about one hour.

13. The battery assembly of claim 1 or 2, wherein the battery is a zinc-air battery.

14. The battery assembly of claim 1 or 2, wherein the barrier includes at least a first layer and a second layer.

* * * * *